US012240566B2

(12) United States Patent
Majhi et al.

(10) Patent No.: US 12,240,566 B2
(45) Date of Patent: Mar. 4, 2025

(54) MODULAR OFFSHORE FLOATING PLATFORM SYSTEMS AND METHODS FOR OPERATING THE SAME

(71) Applicant: ExxonMobil Technology and Engineering Company, Spring, TX (US)

(72) Inventors: Sai Mohan Majhi, Houston, TX (US); Patrick C. Wong, Cypress, TX (US); Gary L. Hurst, Houston, TX (US); Donghwan Lee, The Woodlands, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 520 days.

(21) Appl. No.: 17/658,114

(22) Filed: Apr. 6, 2022

(65) Prior Publication Data

US 2022/0371695 A1 Nov. 24, 2022

Related U.S. Application Data

(60) Provisional application No. 63/190,270, filed on May 19, 2021.

(51) Int. Cl.

| | |
|---|---|
| ***B63B 22/02*** | (2006.01) |
| ***B63B 21/50*** | (2006.01) |
| ***B63B 35/44*** | (2006.01) |
| ***E21B 43/01*** | (2006.01) |

(52) U.S. Cl.
CPC ..... *B63B 22/021* (2013.01); *B63B 21/50* (2013.01); *E21B 43/0107* (2013.01); *B63B 2035/448* (2013.01)

(58) Field of Classification Search
CPC . B63B 22/021; B63B 21/50; B63B 2035/448; E21B 43/0107
See application file for complete search history.

(56) References Cited

FOREIGN PATENT DOCUMENTS

| | | | | |
|---|---|---|---|---|
| NO | 316463 B1 * | 1/2004 | ..... | B63B 35/44 |
| RU | 2485003 C2 * | 6/2013 | ..... | B63B 21/508 |

* cited by examiner

*Primary Examiner* — Anthony D Wiest
(74) *Attorney, Agent, or Firm* — ExxonMobil Technology and Engineering Company—Law Department

(57) ABSTRACT

A modular floating platform system includes a detachable floating buoy providing a body tethered to a seafloor with a plurality of mooring lines and coupled to a subsea production system via one or more communication lines, and a plurality of floating surface facilities, each floating surface facility providing a standardized bottom interface matable with the detachable floating buoy. A latching mechanism individually couples each floating surface facility to the detachable floating buoy when each floating surface facility is individually mated to the detachable floating buoy. One or more communication couplings place each floating surface facility in communication with the subsea production system via the one or more communication lines when each floating surface facility is individually mated to the detachable floating buoy.

21 Claims, 9 Drawing Sheets

MODULAR OFFSHORE FLOATING PLATFORM SYSTEMS AND METHODS FOR OPERATING THE SAME

CROSS REFERENCE TO RELATED APPLICATIONS

This application claims the benefit of U.S. Provisional Application No. 63/190,270, filed May 19, 2021, the disclosure of which is herein incorporated by reference in its entirety.

FIELD OF THE INVENTION

This application relates generally to the design and construction of offshore floating platform structures and, more particularly, to a scalable and interchangeable floating platform system.

BACKGROUND OF THE INVENTION

In the oil and gas industry, offshore floating platforms have been used to expand oil and gas exploration and production to deepwater environments. As used herein the term "offshore floating platform" refers to any ship, vessel, facility, or structure used in an offshore environment and in which the weight of the structure is supported by buoyancy in water. Offshore floating platforms typically require intricate and sometimes complex mooring and riser systems to secure the platform to the seafloor and provide a means for transferring production fluids (e.g., oil, gas, water, etc.) and power and control systems as applicable to the surface facility.

In the past, some offshore platform systems have employed "turret buoy" systems designed to releasably attach offshore floating platforms to subsea production systems. Turret buoy systems commonly include a submersible floating buoy locked into a receptacle located at the lower end of a disconnectable turret. The buoy is tethered to the seafloor with mooring lines, and one or more risers extend to the subsea production system to transfer production fluids, power, etc. The buoy is also mounted on a swivel that allows the buoy to rotate as needed with changes in sea currents. Turret-based disconnectable systems are expensive and often constrained with limitations on the number and size of deployable risers as well as pressure and temperature limits for the swivel and associated swivel seals.

Offshore floating platforms are commonly sized for 'peak capacity,' which oftentimes results in the platform being underutilized for most of its service life once hydrocarbon production falls from peak production. The complexity, time, and cost associated with swapping out conventional floating offshore platforms, however, diminishes the potential to maximize its capacity utilization at other, more appropriate, locations.

What is needed, therefore, is a standardized and modular floating platform system capable of moving assets to offshore hydrocarbon fields that maximize the value of such assets. Such systems may allow operators to size topside modules of each offshore floating platform to the specific field production profile.

SUMMARY OF THE INVENTION

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

In one or more embodiments, a modular floating platform system is disclosed and includes a detachable floating buoy communicably coupled to a subsea production system via one or more communication lines, a plurality of floating surface facilities individually matable with the detachable floating buoy at a standardized bottom interface provided on each floating surface facility, a latching mechanism that individually couples each floating surface facility to the detachable floating buoy when each floating surface facility is individually mated to the detachable floating buoy, and one or more communication couplings that place each floating surface facility in communication with the subsea production system via the one or more communication lines when each floating surface facility is individually mated to the detachable floating buoy.

In one or more embodiments, a method of operating a modular floating platform system is disclosed and includes the steps of communicably coupling a detachable floating buoy to a subsea production system at an offshore location via one or more communication lines, the detachable floating buoy providing a central aperture, mating a floating surface facility to the detachable floating buoy, the floating surface facility including a standardized bottom interface comprising a plug portion matable with the central aperture, placing the floating surface facility in communication with the subsea production system via the one or more communication lines as the plug portion mates with the central aperture, and securing the floating surface facility to the detachable floating buoy with a latching mechanism.

BRIEF DESCRIPTION OF THE DRAWINGS

The following figures are included to illustrate certain aspects of the disclosure, and should not be viewed as exclusive configurations. The subject matter disclosed is capable of considerable modifications, alterations, combinations, and equivalents in form and function, as will occur to those skilled in the art and having the benefit of this disclosure.

DETAILED DESCRIPTION OF THE INVENTION

The present disclosure describes scalable and interchangeable offshore floating platform systems. Embodiments described herein include a detachable floating buoy tethered to a seafloor with a plurality of mooring lines and coupled to a subsea production system via one or more communication lines. A plurality of floating surface facilities may each be able to mate with the detachable floating buoy via a standardized bottom interface without the need to use turrets or swivel systems. Rather, in contrast to turret-based systems incorporating swivels, the embodiments disclosed herein are able to deploy larger and more numerous risers, and are not constrained by the temperature and pressure limitations of swivels. Moreover, as the floating surface facilities individually mate with the detachable floating buoy, each floating surface facility may be placed in communication with the subsea production system via the communication lines. The systems described herein enables an operator to replace, swap out, or re-deploy floating surface facilities as needed to match the desired capacity through the field service life and/or reservoir depletion profile. Moreover, the systems described herein facilitate relatively quick, simple, and easy deployment and demobilization of offshore floating platform facilities to various locations, as needed. Consequently, an operator can maximize value from the deployed asset by using a correctly-sized floating platform facility that matches varying reservoir profiles through field service.

Figure 1:
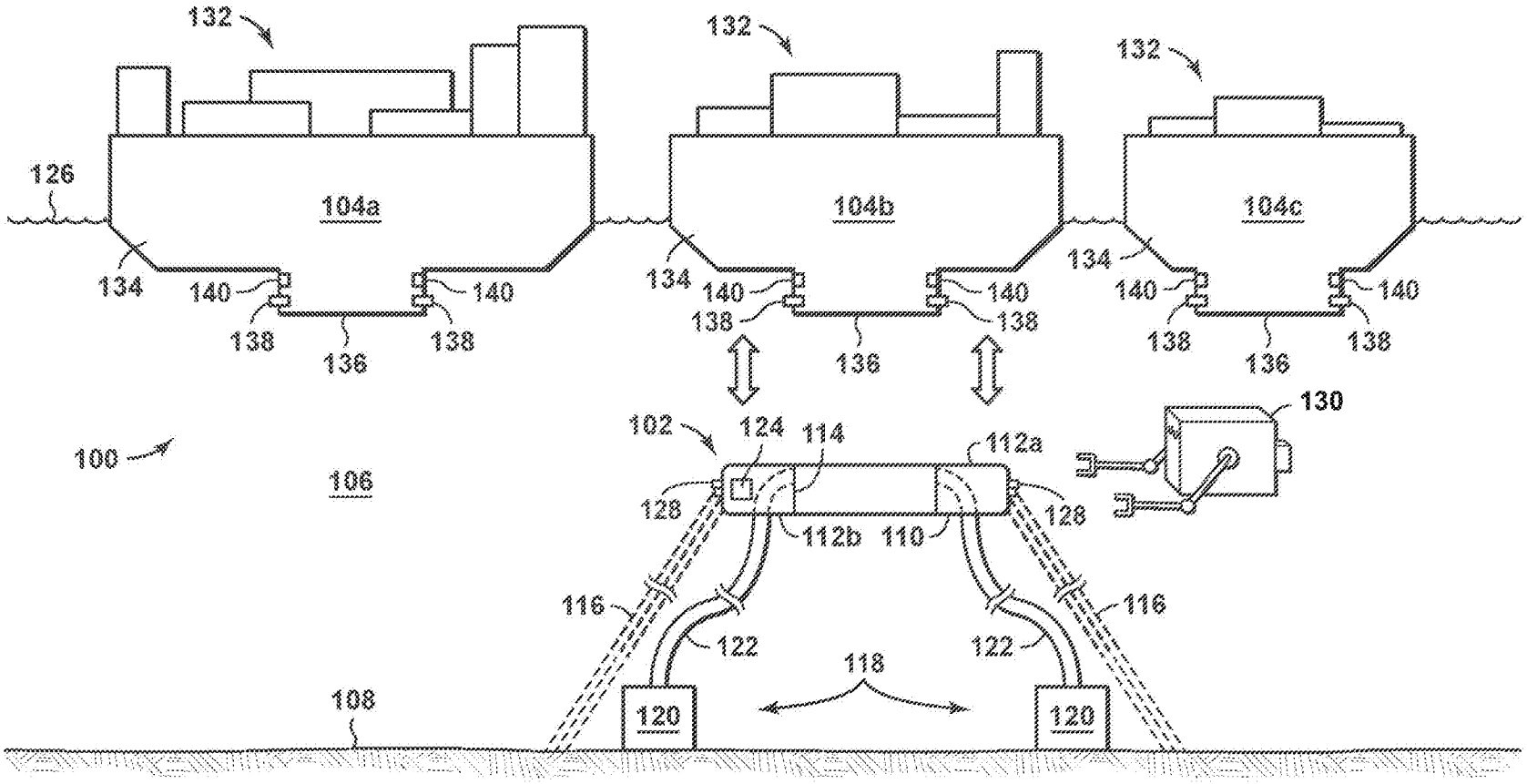
FIG. 1 is a schematic diagram of an example modular floating platform system, according to one or more embodiments.

FIG. 1 is a schematic diagram of an example modular floating platform system 100, according to one or more embodiments. As illustrated, the modular floating platform system 100 (hereafter "the system 100") includes a detachable floating buoy 102 configured to mate with a plurality of floating surface facilities, shown in FIG. 1 as a first floating surface facility 104*a*, a second floating surface facility 104*b*, and a third floating surface facility 104*c*. The system 100 may be deployed or used in any body of water 106, such as the ocean or any body of freshwater (e.g., lakes, inlets, etc.). In the illustrated embodiment, the system 100 is deployed in an offshore oceanic environment, and portions of the system 100 may be secured to a seafloor 108 at the bottom of the ocean.

As described in more detail below, the floating surface facilities 104*a-c* may each be matable with the detachable floating buoy 102 via a standardized bottom interface, but may be provided (manufactured) in varying sizes and exhibiting corresponding varying capabilities and capacities. The varying capabilities and capacities of the floating surface facilities 104*a-c* may prove advantageous in allowing an operator to use an appropriately sized floating surface facility 104*a-c* based on the current production profile of an offshore hydrocarbon field. As a result, operators are able to maximize capital value by using the most efficient (appropriate) floating surface facility 104*a-c* that matches a varying reservoir profile through field service.

The detachable floating buoy 102 may comprise a generally annular body 110 having a top 112*a* and a bottom 112*b*. A central aperture 114 is defined or provided by the body 110 and sized to mate with a standardized bottom interface 136 of each floating surface facility 104*a-c*. In some embodiments, the central aperture 114 extends entirely through the body 110 between the top and the bottom 112*a,b*, but could alternatively extend from the top 112*a* past the bottom 112*b*, without departing from the scope of the disclosure.

The detachable floating buoy 102 may be tethered to an anchoring system (not shown) at the seafloor 108 with a plurality of mooring lines 116 attached to the body 110. In some embodiments, the buoy 102 is "spread moored" using mooring lines 116 that extend from several sides or locations about the outer periphery of the body 110. This spread-moored arrangement helps to stabilize the system 100 when the detachable floating buoy 102 is mated with one of the floating surface facilities 104*a-c* and also helps maintain the system 100 in place in the water 106 during use.

The detachable floating buoy 102 may also be in communication with a subsea production system 118 arranged at the seafloor 108. The production system 118 may be configured to collect production fluids (e.g., liquid or gaseous hydrocarbons, water, etc.) from one or more hydrocarbon-bearing reservoirs. More specifically, the subsea production system 118 may include one or more subsea trees 120 (two shown) and the detachable floating buoy 102 may be communicably coupled to the subsea trees(s) 120 via one or more communication lines 122. The communication lines 122 can include one or more riser conduits (e.g., pipes, hoses, etc.) for transferring production fluids (oil, gas, water, etc.) from the subsea tree(s) 120 to the detachable floating buoy 102. The communication lines 122 can also include one or more umbilicals that facilitate the transfer of power, hydraulics, and/or communication signals to the subsea tree(s) 120. Each umbilical may comprise, for example, a single conduit that includes a plurality of pipes, tubes, cables, fiber optics, or other channels used to convey utilities and communications within the conduit. Once the detachable floating buoy 102 successfully mates with one of the floating surface facilities 104*a-c*, power, communication signals, and hydraulics may be transferred between the floating surface facility 104*a-c* and the subsea production system 118 via the communication lines 122 to enable remote operation of the subsea production system 118.

In some embodiments, the detachable floating buoy 102 may further include a ballast system 124 operable to adjust the buoyancy of the detachable floating buoy 102 and thereby adjust its depth within the water 106 and relative to the water surface 126. The ballast system 124 may include one or more buoyancy connections 128 in fluid communication with one or more variable ballast tanks or compartments (not shown) provided within the body 110. The ballast tanks may be flooded or evacuated either using gravity (e.g., passively) or using a pumping system (e.g., actively) to alter the buoyancy of the detachable floating buoy 102 and thereby adjust its depth.

In some embodiments, for example, the ballast system 124 may include one or more active pumps operable to pump water in or out of the ballast tanks and thereby adjust buoyancy. In such embodiments, an underwater vehicle 130, such as a remotely operated vehicle (ROV) or an autonomous underwater vehicle (AUV), may connect to the detachable floating buoy 102 at the buoyancy connections 128; e.g., via a hot stab connection. Once connected at the buoyancy connections 128, the underwater vehicle 130 may operate the pumps included in the ballast system 124 and thereby flood or evacuate the variable ballast compartments, as desired. Alternatively, a combination of a support vessel (not shown) and a diver (not shown) may be able to accomplish the same operation by manually connecting the support vessel to the detachable floating buoy 102 at the buoyancy connections 128.

In other embodiments, however, the underwater vehicle 130 or a diver may be able to open the ballast compartments at the buoyancy connections 128 and thereby flooding the variable ballast compartments and allow gravity to adjust the buoyancy (depth) of the detachable floating buoy 102. Accordingly, the depth of the detachable floating buoy 102 may be adjusted independent of the floating surface facilities 104*a-c* using any combination of underwater vehicles 130, divers, and support vessels.

In some embodiments, the ballast system 124 may be designed to achieve fixed buoyancy by using low density fixed buoyant materials, such as syntactic foam within the buoy structure. Such fixed buoyant materials may be arranged in specific fixed ballast compartments for managing buoy weight, buoyancy, and stability.

Each floating surface facility 104*a-c* includes a main floater body or hull 134 that allows the facilities 104*a-c* to float on the water 106 at the water surface 126. Each floating surface facility 104*a-c* also carries with it or otherwise houses one or more topside modules 132, also referred to as the "superstructure" of the floating surface facility 104*a-c*. Example topside modules 132 can include, but are not limited to, accommodation, local equipment control rooms, subsea control, power generation and utilities, oil processing, gas processing, water processing, chemical handling, flare, metering skids, any combination thereof, and other modules or equipment common to offshore floating platforms.

Depending on which topside modules 132 are included, each floating surface facility 104*a-c* may be operated as a vessel or platform commonly employed in the oil and gas industry, including, but not limited to, a floating production storage and offloading (FPSO) vessel, a floating storage and offloading (FSO) vessel, a floating production unit (FPU) vessel, a floating liquefied natural gas (FLNG) platform, a floating storage regasification unit (FSRU) vessel, a floating storage regasification unit-power and water (FSRUPW) platform, a floating control station (FCS) vessel, or a 'Floatel (Accommodation Vessel)'.

In other embodiments, however, the floating surface facilities 104*a-c* may be customized with topside modules 132 directed to other offshore operations, such as a floating desalination plant. In such embodiments, the topside modules 132 might include accommodation, power generation, water treatment, electrical transmission, etc. Accordingly, the presently disclosed system 100 is not limited to use in the oil and gas industry but is equally applicable to other industries outside of the oil and gas industry and that may require an offshore floating platform. Other applicable industries include, but are not limited to, (1) low-carbon and renewables industry applications, such as floating wind energy, wave energy, solar energy, carbon sequestration, etc., (2) space and aviation industry to aid launch and recovery of aircrafts or spacecraft and, (3) food industry applications, such as floating farms and food processing facilities. As will be appreciated, the topsides modules 132 and superstructure can be customized depending on the intended application.

As indicated above, each floating surface facility 104*a-c* may further include a standardized bottom interface designed to mate and connect with the detachable floating buoy 102. More specifically, each floating surface facility 104*a-c* may include a plug portion 136 arranged at or near the bottom of the hull 134 and otherwise extending downward (deeper into the water 106) therefrom. The plug portion 136 may be sized and shaped to be received within the central aperture 114 of the detachable floating buoy 102.

Once the plug portion 136 is properly received within the central aperture 114, the detachable floating buoy 102 may be mechanically coupled to the particular floating surface facility 104*a-c* using a latching mechanism 138. The latching mechanism 138 may comprise any type of mechanical locking device including, but not limited to, latches, dogs, wedges, jacks, hooks, connectors, chains, ropes, electromagnets utilizing mechanical, hydraulic, pneumatic, electrical interfaces, or any combination thereof. In the illustrated embodiment, the latching mechanism 138 is shown as being arranged on the plug portion 136, but could alternatively be arranged on the detachable floating buoy 102. In other embodiments, corresponding portions of the latching mechanism 138 may be included on both the plug portion 136 and the detachable floating buoy 102, without departing from the scope of the disclosure. Moreover, the latching system 138 may include multiple components included at multiple locations at the interface between the plug portion 136 and the central aperture 114.

Each floating surface facility 104*a-c* may further include one or more communication couplings 140 configured to place the corresponding floating surface facility 104*a-c* in communication with the communication lines 122 once the floating surface facility 104*a-c* mates with the detachable floating buoy 102. As illustrated, the communication coupling(s) 140 may be arranged on the plug portion 136, and may configured to mate with the communication lines 122 terminating on the inner surface of the central aperture 114. In other embodiments, however, the communication coupling(s) 140 may be arranged on the inner surface of the central aperture 114, or corresponding portions of the communication coupling(s) 140 may be included on both the plug portion 136 and the detachable floating buoy 102, without departing from the scope of the disclosure.

The communication couplings 140 may comprise any type of device or mechanism suitable for operatively and communicably coupling the corresponding floating surface facility 104*a-c* to the communication lines 122. In at least one embodiment, for example, the communication couplings 140 may comprise quick-stab type riser connectors or piping couplers to provide necessary latching and sealing for communication of fluids, power and controls, without the need for turrets or swivels.

Once the communication lines 122 are properly mated with the communication couplings 140, the contents within the riser conduits (e.g., oil, gas, water, etc.) may be transferred from the subsea production system 118 to the corresponding mated floating surface facility 104*a-c*. Moreover, once the communication lines 122 are properly mated with the communication couplings 140, power, electrical signals, and hydraulics, may be transferred within the umbilicals between the floating surface facility 104*a-c* and the subsea production system 118 in either direction.

As illustrated, the floating surface facilities 104*a-c* may be manufactured in varying sizes and are thereby able to accommodate topside modules 132 appropriate for varying applications. In the illustrated embodiment, the first floating surface facility 104*a* is larger than the second floating surface facility 104*b*, which is larger than the third floating surface facility 104*c*. As mentioned above, the varying sizes of the floating surface facilities 104*a-c* may prove advantageous in allowing an operator to employ an appropriately sized floating surface facility 104*a-c* based on the current production profile of the offshore hydrocarbon field.

For example, in the first five years of operation, the production profile of a given offshore hydrocarbon field may exhibit maximum production, which would necessitate using the first floating surface facility 104*a* to accommodate the elevated (maximum) production capacity. In the next ten years, however, the production profile may diminish and exhibit medium production based on reservoir depletion trends, which can be accommodated using the second floating surface facility 104*b*. At that time, an operator may decide to decouple the first floating surface facility 104*a* from the detachable floating buoy 102 and replace it with the second floating surface facility 104*b*. The first floating surface facility 104*a* may then be moved to another location where its enlarged capacity and capabilities can be best utilized.

Furthermore, in the last five to ten years, the production profile of the hydrocarbon field may diminish even further based on reservoir depletion trends and exhibit minimal production, which can be accommodated using the third (and smallest) floating surface facility 104*c*. At that time, the second floating surface facility 104*b* may be decoupled from the detachable floating buoy 102 and replaced with the third floating surface facility 104*c*. The second floating surface facility 104*b* may then be moved to another location where its capacity and capabilities can be best utilized. As will be appreciated, the 'plug-and-play' capability of the presently described system 100 maximizes the value of each floating surface facility 104*a-c* by avoiding underutilization beyond peak production. The system 100 facilitates relatively quick, simple, and easy deployment and demobilization of the floating surface facilities 104*a-c* to various locations, thus enabling an operator to maximize value by using the most efficient (appropriate) asset that matches varying reservoir profile through field service.

Figure 2:
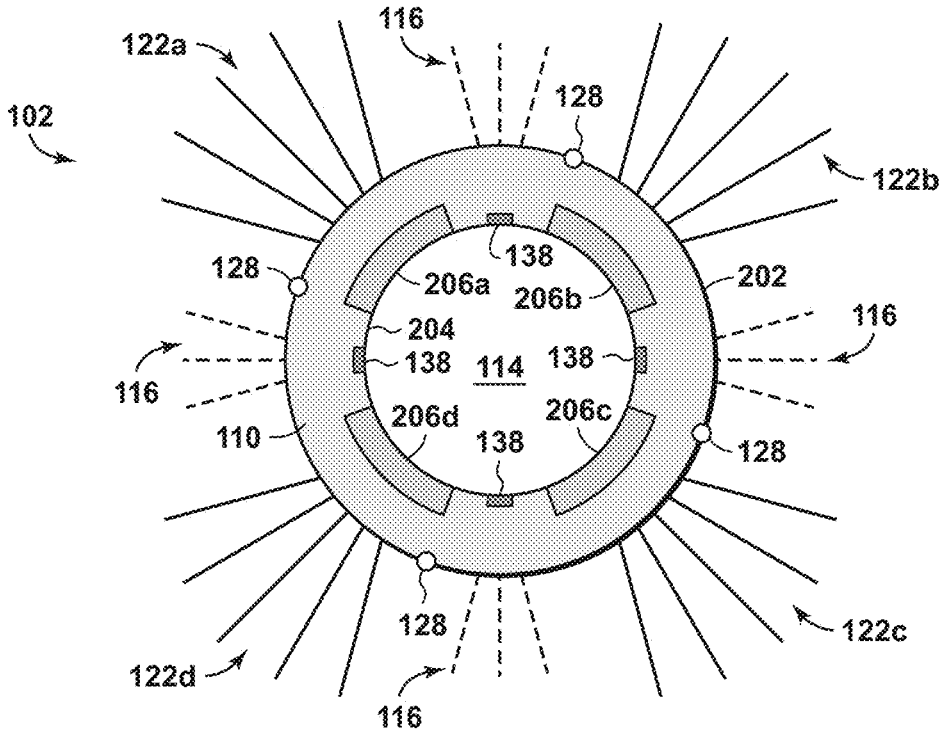
FIG. 2 is a top view of the detachable floating buoy of FIG. 1, according to one or more embodiments.

FIG. 2 is a top view of the detachable floating buoy 102, according to one or more embodiments. In the illustrated embodiment, the annular body 110 exhibits a generally circular or round cross-sectional shape, and the central aperture 114 defined by the body 110 is similarly circular or round. Consequently, an outer periphery (circumference) 202 of the body 110 is circular, and an inner surface 204 of the central aperture 114 is likewise circular. As discussed herein, however, the body 110 may exhibit other cross-sectional shapes, without departing from the scope of the disclosure.

In some embodiments, as illustrated, the shape of the body 110 may be axisymmetric, which may prove advantageous in use at locations with omnidirectional metocean extreme environments, where resulting environmental loads on and the hydrodynamic response of the 'modular offshore floating platform system' from all directions remain similar. Moreover, in the illustrated embodiment, the annular body 110 comprises a monolithic, annular structure, but could alternatively be made up of two or more mechanically coupled arcuate sections, without departing from the scope of the disclosure.

As shown in FIG. 2, the mooring lines 116 may be attached to the outer periphery 202 of the body 110 to secure the detachable floating buoy 102 to the seafloor 108 (FIG. 1). Moreover, the mooring lines 116 can be attached to and extend from multiple sides or locations about the outer periphery 202, thus resulting in a "spread-moored" configuration, as briefly discussed above. The communication lines 122 are also attached to the outer periphery 202 of the body 110 and extend to the detachable floating buoy 102 from the subsea production system 118 (FIG. 1). In some embodiments, as illustrated, attachment of the mooring lines 116 and the communication lines 122 may alternate about the outer periphery 202, but could alternatively be arranged in any other order or configuration, without departing from the scope of the disclosure.

In the illustrated embodiment, the communication lines 122 are depicted as a first set of communication lines 122*a*, a second set of communication lines 122*b*, a third set of communication lines 122*c*, and a fourth set of communication lines 122*d*. In some embodiments, the first set of communication lines 122*a* may be configured to convey a first fluid type (e.g., oil) to the detachable floating buoy 102, the second set of communication lines 122*b* may be configured to convey a second fluid type (e.g., gas) to the detachable floating buoy 102, and the third set of communication lines 122*c* may be configured to convey a third fluid type (e.g., water) to the detachable floating buoy 102. The fourth set of communication lines 122*d* may be configured to convey power, command signals, hydraulics, etc. between the subsea production system 118 (FIG. 1) and the detachable floating buoy 102.

In the illustrated embodiment, each set of communication lines 122*a-d* terminates at a corresponding communication coupling, shown as a first communication coupling 206*a*, a second communication coupling 206*b*, a third communication coupling 206*c*, and a fourth communication coupling 206*d*. The communication couplings 206*a-d* may be configured to mate with the communication couplings 140 (FIG. 1) provided on the floating surface facilities 104*a-c* (FIG. 1) when any of the floating surface facilities 104*a-c* are mated to the detachable floating buoy 102. Accordingly, the communication couplings 140, 206*a-d* may cooperatively form a coupling assembly configured to place the floating surface facilities 104*a-c* in communication with the subsea production system 118. In some embodiments, some or all of the communication couplings 140, 206*a-d* may comprise fluid manifolds used to route riser fluids (oil, gas, water, etc.) to appropriate destinations. Fluid manifolds may be utilized to facilitate communication from the communication couplings 206*a-d* to the appropriate topsides modules 132.

In some embodiments, as illustrated, the detachable floating buoy 102 may also include the latching mechanism 138 (or a portion thereof), shown as four separate latching components spread about the inner surface 204 of the central aperture 114. As described above, the latching mechanism 138 may be used to mechanically couple the floating surface facility 104*a-c* (FIG. 1) to the detachable floating buoy 102.

Lastly, FIG. 2 also shows the buoyancy connections 128 arranged about the outer periphery 202 of the body 110. As described above, the buoyancy connections 128 may provide access to one or more variable ballast tanks (not shown) provided within the body 110 to alter the buoyancy of the detachable floating buoy 102 and thereby adjust its depth within the water 106 (FIG. 1).

Figure 3A:
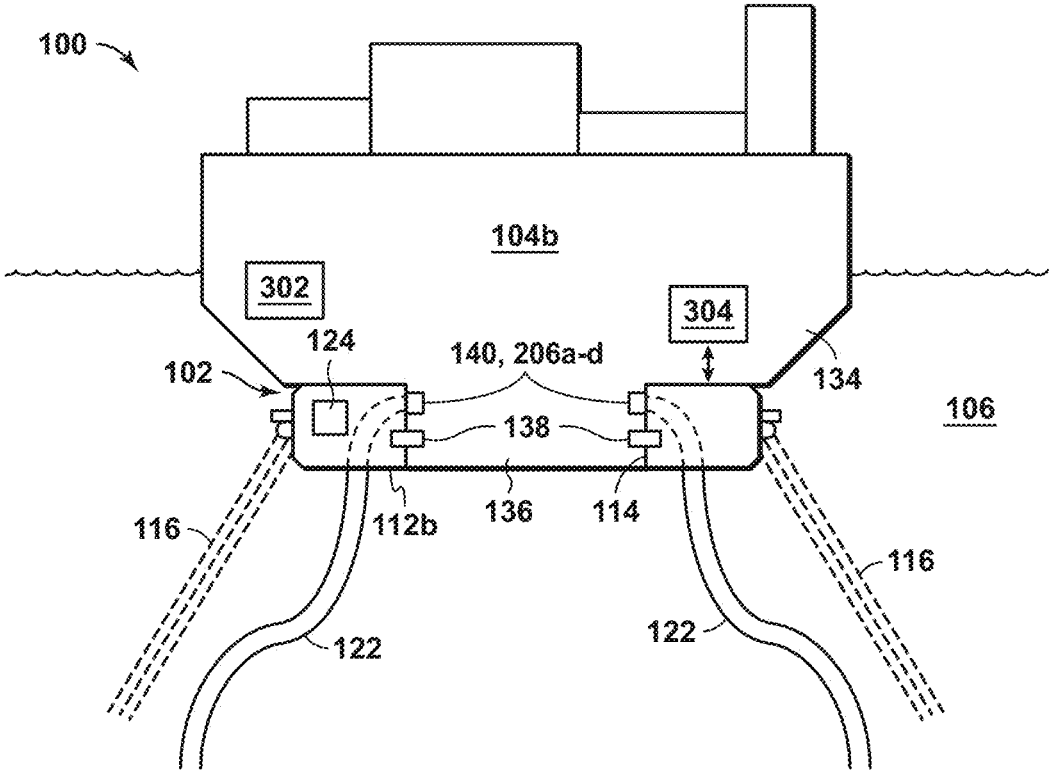
FIGS. 3A-3C are side views of various examples of the system of FIG. 1 depicting the second floating surface facility mated with the detachable floating buoy, according to the present disclosure.
Figure 3B:
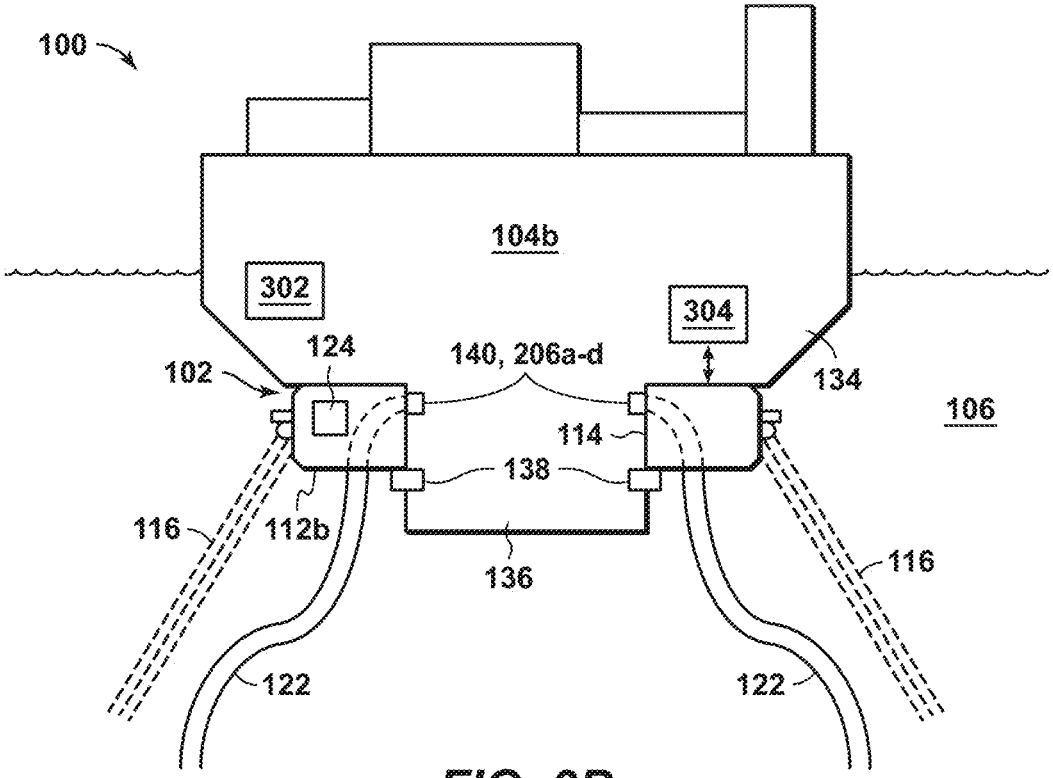
Figure 3C:
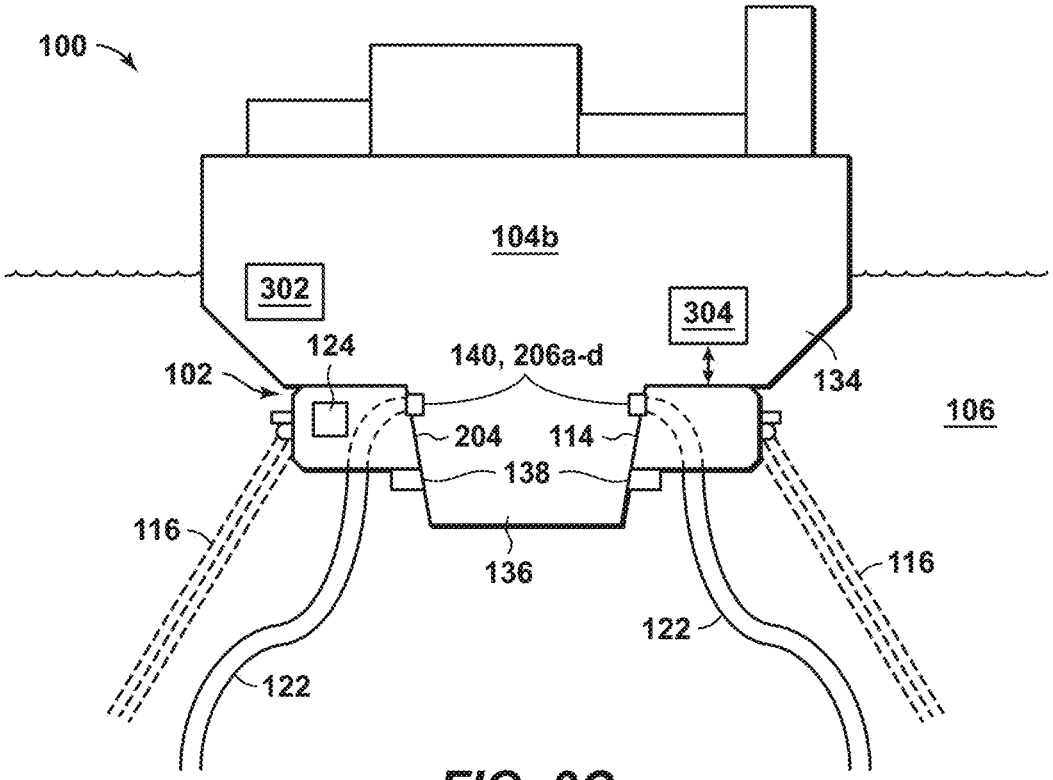

FIGS. 3A-3C are side views of various examples of the system 100 of FIG. 1 depicting the second floating surface facility 104*b* mated with the detachable floating buoy 102, according to one or more embodiments. While the following discussion is directed to mating the second floating surface facility 104*b* with the detachable floating buoy 102, the discussion is equally applicable to mating the first or third floating surface facility 104*a,c* with the detachable floating buoy 102.

The process of mating the second floating surface facility 104*b* with the detachable floating buoy 102 may first entail vertically aligning the plug portion 136 of the hull 134 with the central aperture 114 of the detachable floating buoy 102. Once aligned, the vertical distance between the second floating surface facility 104*b* and the detachable floating buoy 102 may be closed to enable the plug portion 136 to be received within the central aperture 114. This may be accomplished by 1) operating an internal ballast system 302 included in the second floating surface facility 104*b* and thereby causing the second floating surface facility 104*b* to descend toward the detachable floating buoy 102) operating the ballast system 124 of the detachable floating buoy 102 and thereby causing the detachable floating buoy 102 to ascend toward the second floating surface facility 104*b*, or 3) a combination of the foregoing. Accordingly, the draft of the second floating surface facility 104*b* and the depth of the detachable floating buoy 102 may be adjusted independently of each other.

In at least one embodiment, the second floating surface facility 104*b* may include a winching system 304 operable to help close the distance between the second floating surface facility 104*b* and the detachable floating buoy 102. The winching system 304 may also be useful in helping during disconnection of the second floating surface facility 104*b* from the detachable floating buoy 102. The winching system 304 could consist of a single or multiple loadbearing lines from the floating surface facility 104*b* with corresponding attachment points on detachable floating buoy 102. Alternatively, the operation to help manage the distance between the second floating surface facility 104*b* and the detachable floating buoy 102 could be facilitated by using winch lines of field support vessels. Moreover, in some embodiments, the system 100 may further include one or more orientation mechanisms configured to help properly angularly orient the detachable floating buoy 102 with respect to the hull 134. Properly orienting the detachable floating buoy 102 may be required to enable the communication lines 122 to properly align with corresponding manifolds, etc. within the second floating surface facility 104*b*. Example orientation mechanisms can include, but are not limited to, dogs, keys, slots, any combination thereof, or other types of guides or guiding mechanisms capable of helping to achieve the correct angular orientation (azimuth).

Receiving the plug portion 136 within the central aperture 114 may also simultaneously facilitate operative connection at the communication couplings 140, 206*a-d*, thus placing the second floating surface facility 104*b* in communication (e.g., production fluids, power, communication signals, hydraulics, etc.) with the subsea production system 118 (FIG. 1) via the communication lines 122. Moreover, once properly mated, the second floating surface facility 104*b* may be mechanically coupled to the detachable floating buoy 102 with the latching mechanism 138, as generally described above. Once mechanically mated, the mooring lines 116 help stabilize the entire system 100 within the water 106 and help maintain the system 100 in place during use.

In FIG. 3A, the length (depth) of the plug portion 136 is sized such that it does not protrude past the bottom 112*b* of the detachable floating buoy 102. In at least one embodiment, the bottom of the plug portion 136 may reside flush or substantially flush with the bottom 112*b* of the detachable floating buoy 102.

In FIG. 3B, in contrast, the length (depth) of the plug portion 136 is sized such that it protrudes past the bottom 112*b* of the detachable floating buoy 102. The increased length (depth) of the plug portion 136 may prove advantageous for a few reasons. First, a larger plug portion 136 allows for more storage space within the hull for produced fluids. Second, the longer/larger plug portion 136 can result in enhanced hydrodynamic stability. Lastly, the longer plug portion 136 allows the latching mechanism 138 to be located outside of the central aperture 114 and otherwise beneath the detachable floating buoy 102. This allows an operator to be able to visually inspect the latching mechanism 138 (e.g., by using a diver or ROV) and ensure that it is properly latched and secured.

In FIG. 3C, the plug portion 136 is conical or frustoconical in shape, and the inner surface 204 of the central aperture 114 may be correspondingly angled to accommodate the frustoconical shape. The frustoconical plug portion 136 may prove advantageous in allowing the plug portion 136 to more easily locate and mate with the central aperture 114, thus making the mating process easier.

Figure 4A:
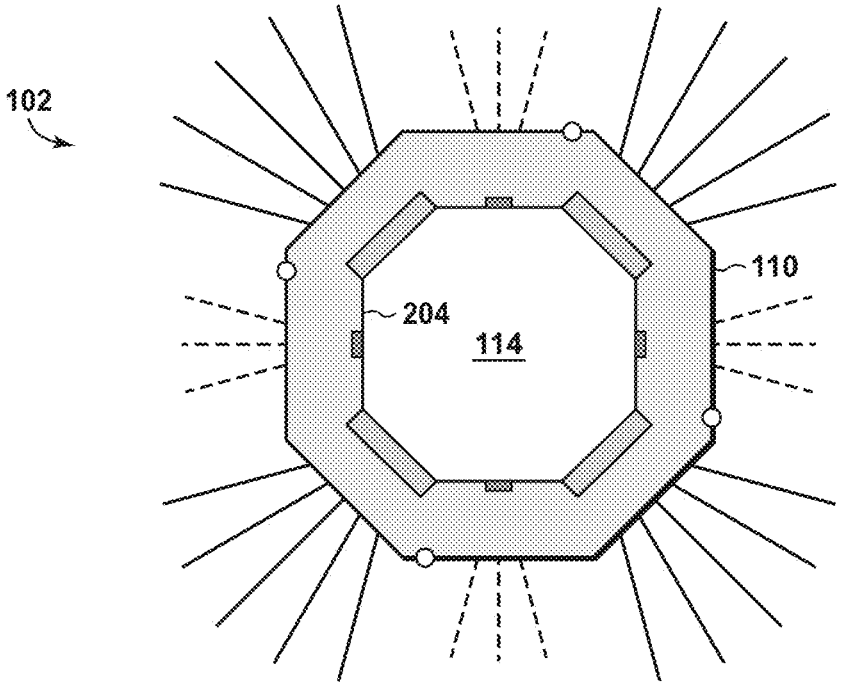
FIGS. 4A-4C are top views of various examples of the detachable floating buoy of FIG. 1, according to the present disclosure.
Figure 4B:
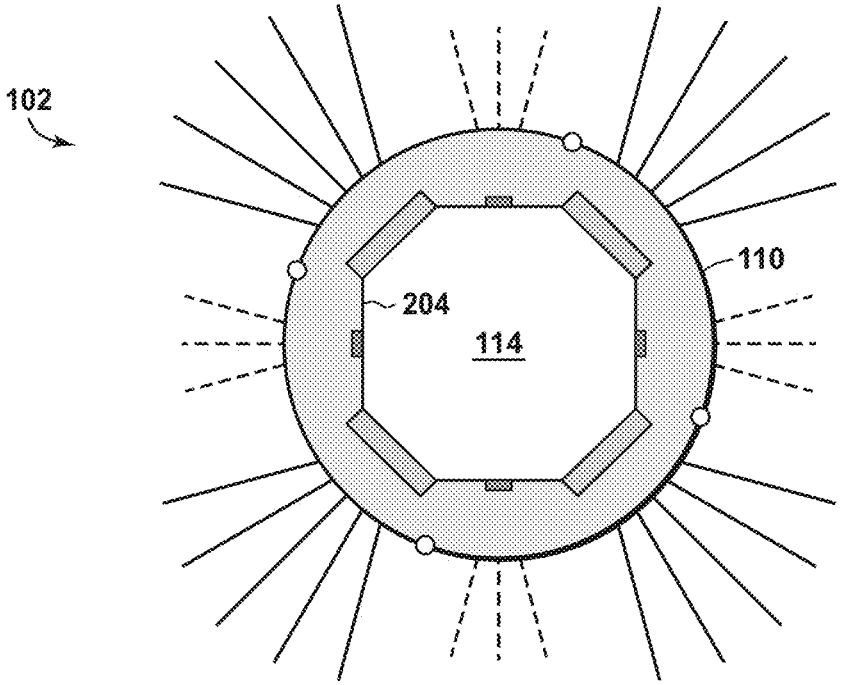
Figure 4C:
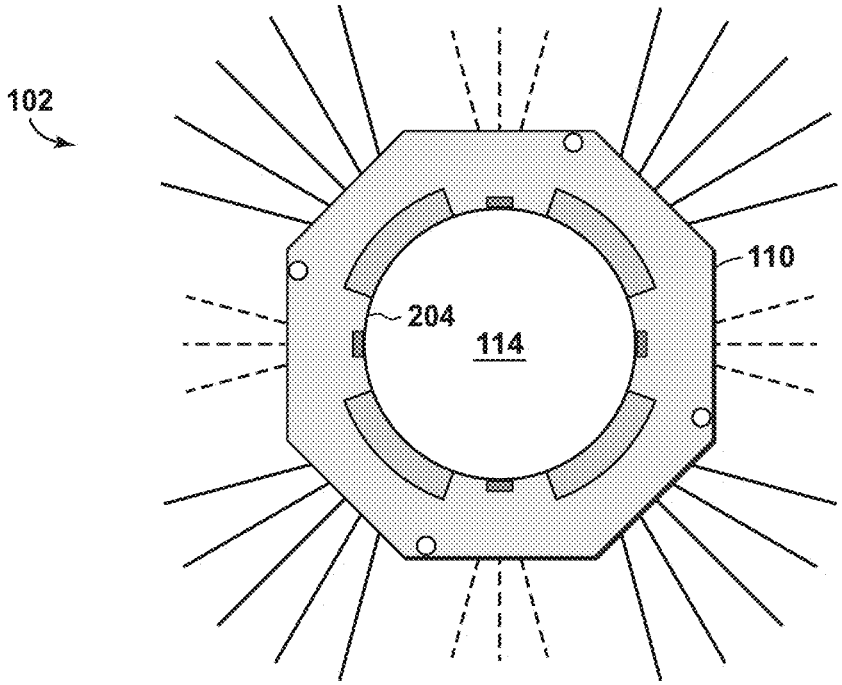

FIGS. 4A-4C are top views of various examples of the detachable floating buoy 102, according to the present disclosure. In FIG. 4A, the annular body 110 exhibits a polygonal cross-sectional shape, and the inner surface 204 of the central aperture 114 defined by the body 110 is similarly polygonal in shape. In the illustrated embodiment, the body 110 and the central aperture 114 each form an octagon. In other embodiments, however, the body 110 and or the central aperture 114 may exhibit other polygonal cross-sectional shapes including, but not limited to, a triangle, a rectangle (including a square), a pentagon, a hexagon, and so forth.

In FIG. 4B, the annular body 110 exhibits a generally circular cross-sectional shape, while the inner surface 204 of the central aperture 114 exhibits a polygonal cross-sectional shape. In particular, and similar to the embodiment of FIG. 4A, the central aperture 114 forms an octagon, but could alternatively exhibit other polygonal cross-sectional shapes, without departing from the scope of the disclosure.

In FIG. 4C, the annular body 110 exhibits a polygonal cross-sectional shape, while the inner surface 204 of the central aperture 114 exhibits a generally circular cross-sectional shape. In particular, and similar to the embodiment of FIG. 4A, the annular body 110 forms an octagon, but could alternatively exhibit other polygonal cross-sectional shapes, without departing from the scope of the disclosure.

Figure 5A:
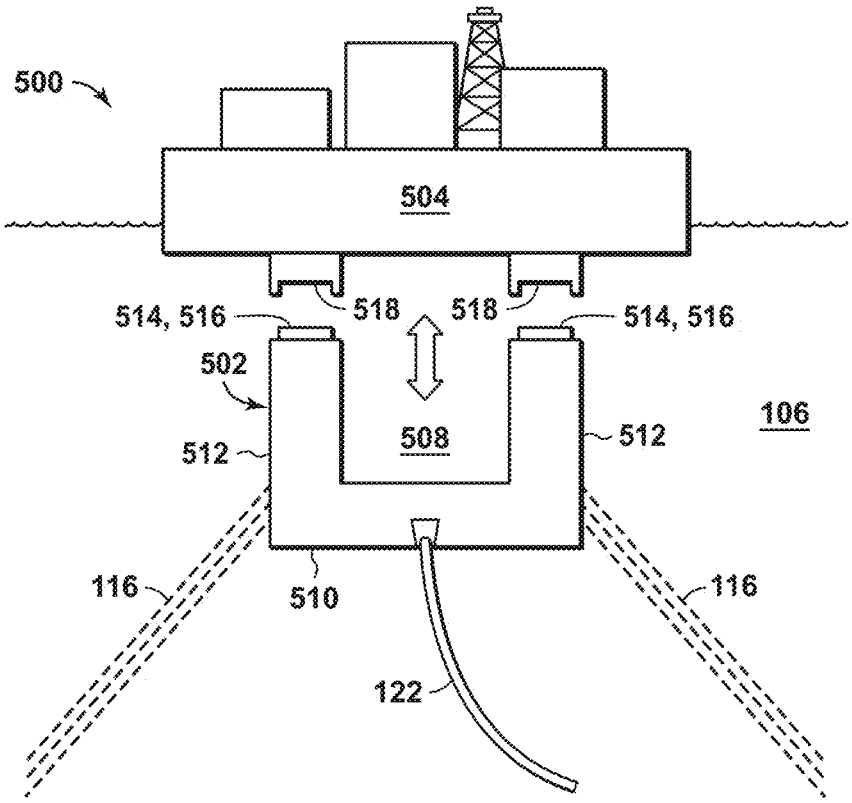
FIGS. 5A-5C are side views of various embodiments of another modular floating platform system, according to one or more embodiments.
Figure 5B:
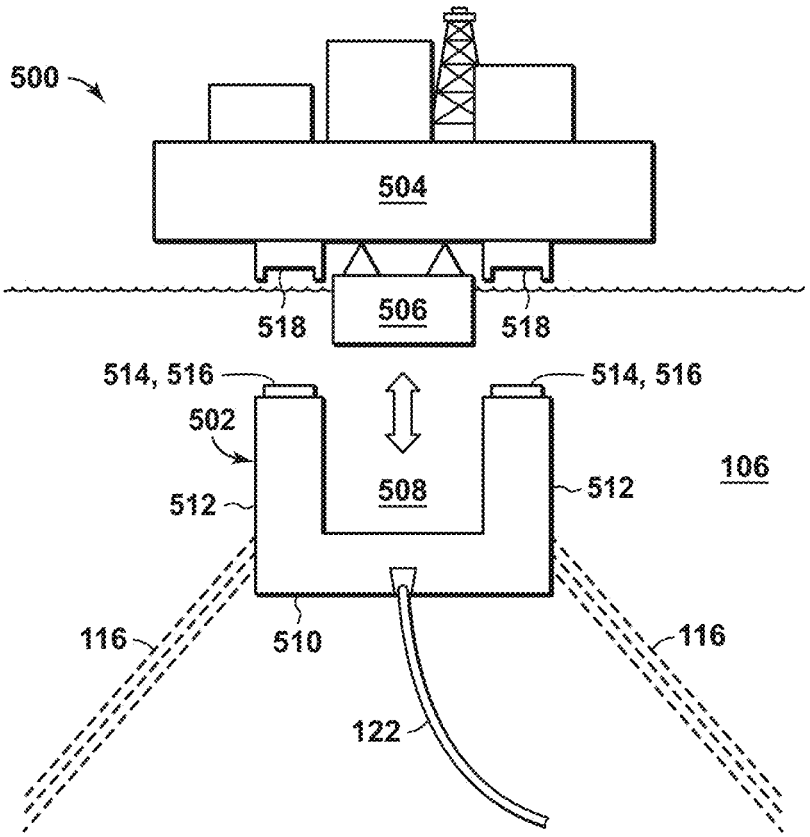
Figure 5C:
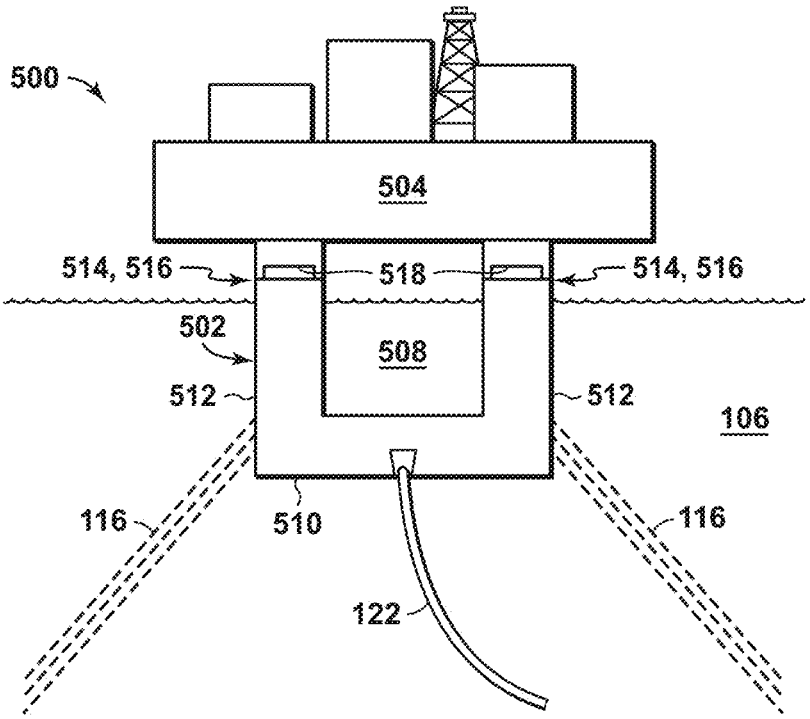

FIGS. 5A-5C are side views of various embodiments of another modular floating platform system 500, according to one or more embodiments. The modular floating platform system 500 (hereafter "the system 500") may be similar in some respects to the system 100 of FIG. 1 and, therefore, may be best understood with reference thereto, where like numerals represent like components not described again in detail. As illustrated, the system 500 includes a detachable floating buoy 502 and a floating surface facility 504. The floating surface facility 504 may be the same as or similar to any of the floating surface facilities 104*a-c* of FIG. 1. In FIG. 5A, the floating surface facility 504 comprises a "wet tow" offshore platform that is towed in the water 106 to the location of the detachable floating buoy 502. In FIG. 5B, however, the floating surface facility 504 comprises a "dry tow" offshore platform that is carried to the location of the detachable floating buoy 502 on a transportation barge 506.

The detachable floating buoy 502 may be similar in some respects to the detachable floating buoy 102 of FIG. 1. More specifically, the detachable floating buoy 502 may be tethered to the seafloor 108 (FIG. 1) with the plurality of mooring lines 116, and may also be in communication with the subsea production system 118 (FIG. 1) via the communication lines 122 (only one shown). The detachable floating buoy 502 may also provide or otherwise define a central aperture 508.

In contrast to the detachable floating buoy 102, however, the detachable floating buoy 502 may include a bottom or "pontoon" 510 such that the central aperture 508 could extend all the way through the detachable floating buoy 502. Moreover, the detachable floating buoy 502 may also include one or more vertical supports or columns 512 extending from the bottom 510. In some embodiments, the buoyancy of the detachable floating buoy 502 can be adjusted such that the vertical supports 512 may be submerged below the water to enable mating with the floating surface facility 504. After the mating is successfully achieved, the buoyancy of the detachable floating buoy 502 can be adjusted such that the vertical supports 512 can extend above the water line such that the connection point to the floating surface facility 504 is above water. In the illustrated embodiments, the detachable floating buoy 502 is depicted as having four vertical supports 512, which can be reduced to at least three vertical supports 512. In at least one embodiment, however, the detachable floating buoy 502 may include a single vertical support 512 in the form of a cylinder (e.g., circular, polygonal, etc.), as generally shown in FIG. 6A, without departing from the scope of the disclosure.

In further contrast to the system 100 of FIG. 1, the system 500 may include vertically mounted latching mechanisms 514 and communication 'stab-in' type couplings 516 with compatible mating receptors 518 on the floating surface facility 504. In the system 100, the latching mechanism 138 (FIGS. 1-3C) and the communication couplings 104, 202*a-d* (FIGS. 1-3C) are all arranged radially for radial interaction at the interface between the floating surface facilities 104*a-c* (FIG. 1) and the detachable floating buoy 102 (FIG. 1). In contrast, the latching mechanisms 514 and the communication couplings 516 of the system 500 may be arranged at a vertical interface between the floating surface facility 504 and the detachable floating buoy 502. In the illustrated embodiment, for example, the latching mechanisms 514 and the communication couplings 516 are arranged at the top of the vertical support(s) 512 and configured to mate with a standardized bottom interface provided on the bottom of the floating surface facility 504. The standardized bottom interface of the floating surface facility 504 may comprise, for example, one or more receptacles configured to receive and otherwise mate with the latching mechanisms 514 and the communication couplings 516. In other embodiments, however, the latching mechanisms 514 and the communication couplings 516 may alternatively be arranged at the bottom of the floating surface facility 504 and configured to mate with the top of the vertical support(s) 512. In yet other embodiments, portions of the latching mechanisms 514 and the communication couplings 516 may be arranged on both the top of the vertical support(s) 512 and the bottom of the floating surface facility 504, without departing from the scope of the disclosure.

Once the latching mechanisms 514 and the communication couplings 516 are properly connected at the interface between the floating surface facility 504 and the detachable floating buoy 502, as shown in FIG. 5C, production fluids, power, command signals, and hydraulics may then be transferred between the subsea production system 118 (FIG. 1) and the floating surface facility 504.

Figure 6A:
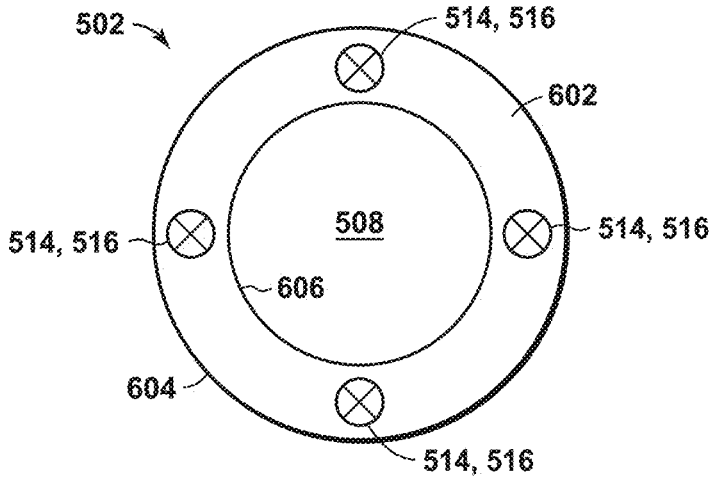
FIGS. 6A-6C are top views of example embodiments of the detachable floating buoy of FIGS. 5A-5C, according to the present disclosure.
Figure 6B:
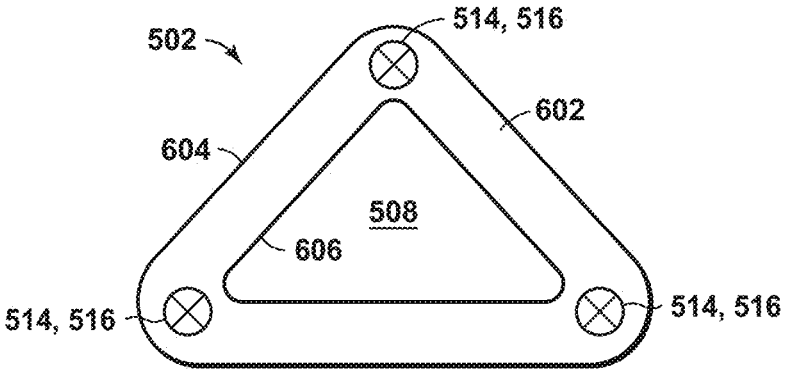
Figure 6C:
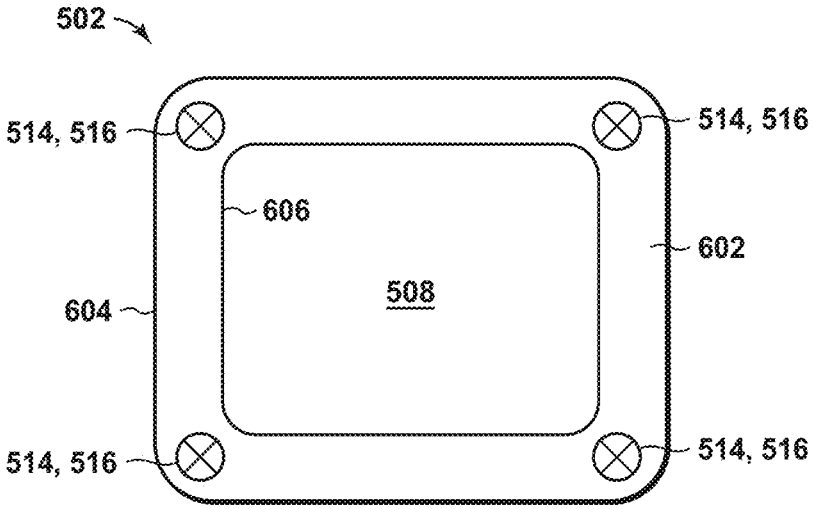

FIGS. 6A-6C are top views of example embodiments of the detachable floating buoy 502, according to the present disclosure. As illustrated, the detachable floating buoy 502 includes a body 602 that defines the central aperture 508. A plurality of latching mechanisms 514 and communication couplings 516, as generally described above, may be mounted to the body 602 in each embodiment. Moreover, the detachable floating buoy 502 can exhibit a variety of different cross-sectional shapes.

In FIG. 6A, for example, the body 602 exhibits a generally circular or round cross-sectional shape, and the central aperture 508 defined by the body 602 is similarly circular or round. Consequently, an outer periphery (circumference) 604 of the body 602 is circular, and an inner surface 606 of the central aperture 508 is similarly circular. In other embodiments, however, the central aperture 508 may be used as a 'moonpool' or 'central-well' and can alternatively exhibit other cross-sectional shapes, such as a polygonal shape, without departing from the scope of the disclosure.

In FIG. 6B, the body 602 exhibits a polygonal cross-sectional shape, and the central aperture 508 is similarly polygonal in shape. In the illustrated embodiment, both the body 602 and the aperture exhibit a triangular cross-sectional shape. Consequently, the outer periphery (circumference) 604 of the body 602 is in the shape of a triangle, and the inner surface 606 of the central aperture 508 is similarly in the shape of a triangle. In other embodiments, however, the central aperture 508 may alternatively exhibit other cross-sectional shapes, such as another polygonal shape or circular, without departing from the scope of the disclosure.

In FIG. 6C, the body 602 again exhibits a polygonal cross-sectional shape, and the central aperture 508 is similarly polygonal in shape. In the illustrated embodiment, both the body 602 and the aperture exhibit a rectangular (including square) cross-sectional shape. Consequently, the outer periphery (circumference) 604 of the body 602 is in the shape of a rectangle, and the inner surface 606 of the central aperture 508 is similarly in the shape of a rectangle. In other embodiments, however, the central aperture 508 may alternatively exhibit other cross-sectional shapes, such as another polygonal shape or circular, without departing from the scope of the disclosure.

Figure 7:
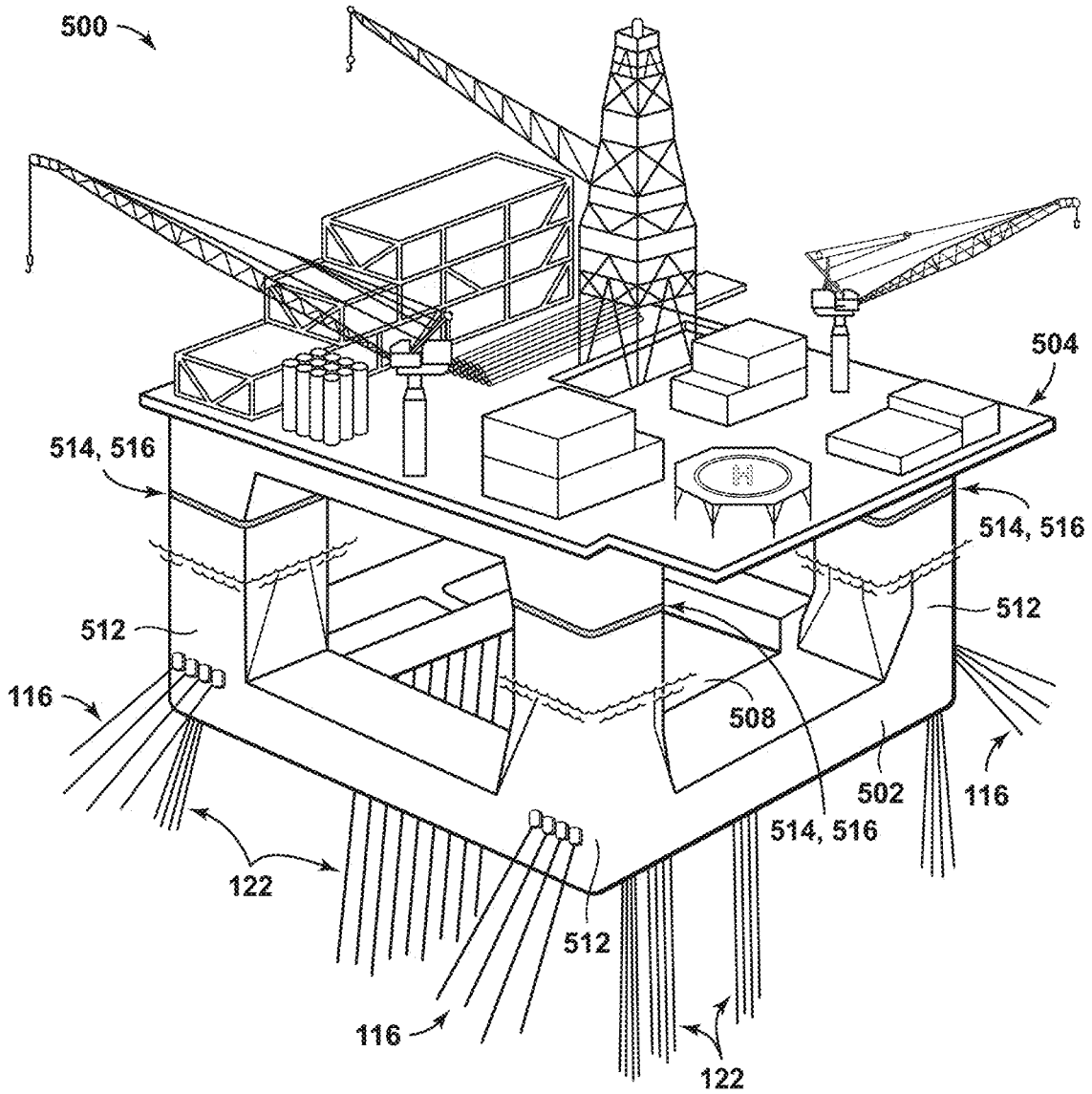
FIG. 7 is an isometric view of the system of FIGS. 5A-5C, according to one or more embodiments.

FIG. 7 is an isometric view of the system 500 of FIGS. 5A-5C, according to one or more embodiments. As illustrated, the system 500 includes the detachable floating buoy 502 shown mated with the floating surface facility 504. The detachable floating buoy 502 is tethered to the seafloor 108 (FIG. 1) with a plurality of mooring lines 116, and communicates with the subsea production system 118 (FIG. 1) via the communication lines 122.

In the illustrated embodiment, the detachable floating buoy 502 exhibits a generally rectangular shape, similar to the embodiment shown in FIG. 6C. In this embodiment, the vertical supports 512 extend from each geometric corner of the detachable floating buoy 502 to be coupled to bottom of the standardized bottom interface of the floating surface facility 504 at four locations. The latching mechanisms 514 and the communication couplings 516 of the system 500 are arranged at the corners to operatively and communicably couple the floating surface facility 504 to the detachable floating buoy 502. Moreover, in the illustrated embodiment, the central aperture 508 is open and thereby provides a 'moonpool' or 'central-well', but could alternatively be closed, without departing from the scope of the disclosure.

Figure 8:
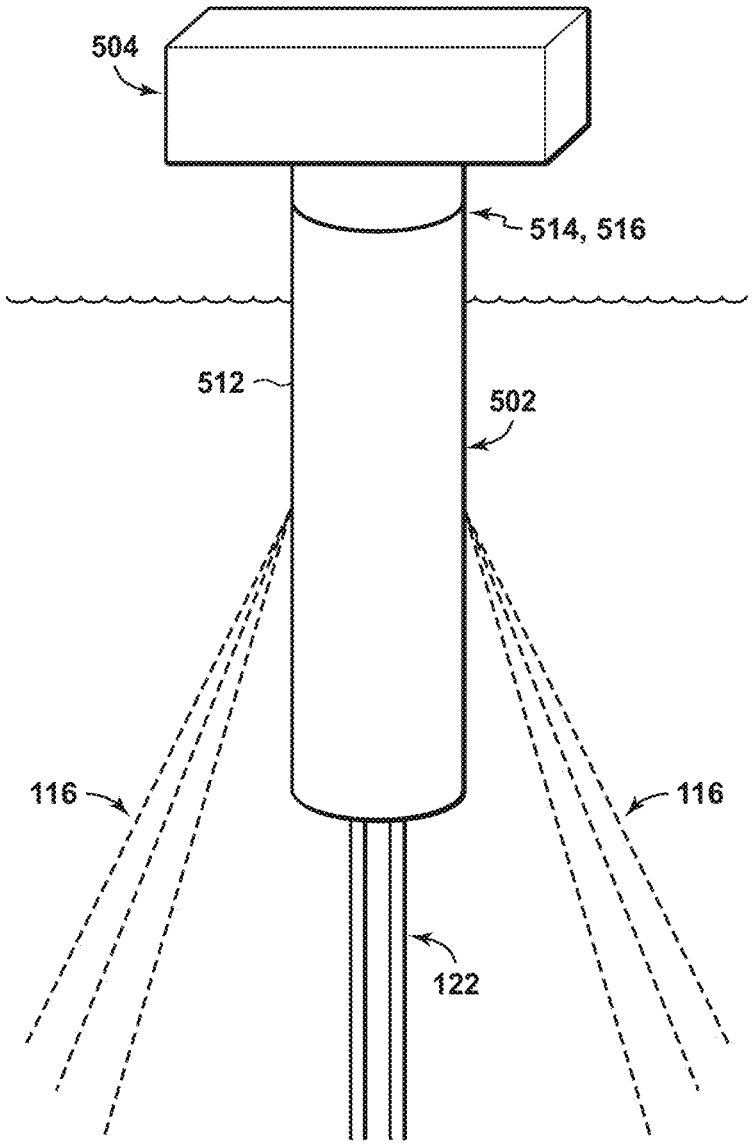
FIG. 8 is an isometric view of the system of FIGS. 5A-5C, according to one or more additional embodiments.

FIG. 8 is an isometric view of the system 500 of FIGS. 5A-5C, according to one or more additional embodiments. As illustrated, the system 500 includes the detachable floating buoy 502 shown mated with the floating surface facility 504. The detachable floating buoy 502 is tethered to the seafloor 108 (FIG. 1) with a plurality of mooring lines 116, and communicates with the subsea production system 118 (FIG. 1) via the communication lines 122.

In the illustrated embodiment, the detachable floating buoy 502 exhibits a generally circular cylindrical shape, similar to the embodiment shown in FIG. 6A. In this embodiment, the vertical support 512 comprises a single, columnar structure. While shown exhibiting a generally circular cross-sectional shape, the vertical support 512 may alternatively exhibit other cross-sectional shapes, including any polygonal shape, without departing from the scope of the disclosure. Moreover, the latching mechanisms 514 and the communication couplings 516 of the system 500 are arranged at the interface between the floating surface facility 504 and the detachable floating buoy 502 to facilitate communication therebetween of production fluids, electrical signals, hydraulics, etc.

One or more illustrative incarnations incorporating one or more invention elements are presented herein. Not all features of a physical implementation are described or shown in this application for the sake of clarity. It is understood that in the development of a physical embodiment incorporating one or more elements of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

While systems and methods are described herein in terms of "comprising" various components or steps, the systems and methods can also "consist essentially of" or "consist of" the various components and steps.

Embodiments Listing

Clause 1: A modular floating platform system includes a detachable floating buoy communicably coupled to a subsea production system via one or more communication lines, a plurality of floating surface facilities individually matable with the detachable floating buoy at a standardized bottom interface provided on each floating surface facility, a latching mechanism that individually couples each floating surface facility to the detachable floating buoy when each floating surface facility is individually mated to the detachable floating buoy, and one or more communication couplings that place each floating surface facility in communication with the subsea production system via the one or more communication lines when each floating surface facility is individually mated to the detachable floating buoy.

Clause 2: The system of Clause 1, wherein the standardized bottom interface of each floating surface facility comprises a plug portion sized to be received within a central aperture defined by the detachable floating buoy.

Clause 3: The system of Clause 2, wherein the plug portion extends into the central aperture but does not protrude past a bottom of the detachable floating buoy.

Clause 4: The system of Clause 2, wherein the plug portion extends into the central aperture and past a bottom of the detachable floating buoy.

Clause 5: The system of Clause 2, wherein the plug portion exhibits a conical shape and an inner surface of the central aperture is angled to accommodate the conical shape.

Clause 6: The system of any of the preceding Clauses, wherein the detachable floating buoy is spread-moored to a seafloor with a plurality of mooring lines.

Clause 7: The system of any of the preceding Clauses, wherein the one or more communication lines comprise one or more riser conduits for transferring production fluids, and one or more umbilicals that facilitate transfer of electrical power, communication signals, and hydraulics.

Clause 8: The system of any of the preceding Clauses, wherein the detachable floating buoy further includes a ballast system operable to adjust a buoyancy of the detachable floating buoy.

Clause 9: The system of Clause 8, wherein the ballast system includes one or more buoyancy connections in fluid communication with one or more ballast tanks, and wherein the ballast tanks are capable of being flooded or evacuated via the one or more buoyancy connections.

Clause 10: The system of any of the preceding Clauses, wherein the detachable floating buoy exhibits a circular or polygonal cross-section.

Clause 11: The system of Clause 10, wherein the detachable floating buoy defines a central aperture that exhibits a circular or polygonal cross-section.

Clause 12: The system of Clause 10, wherein a body of the detachable floating buoy is axisymmetric.

Clause 13: The system of any of the preceding Clauses, wherein the detachable floating buoy includes one or more vertical supports arranged to mate and connect with the standardized bottom interface provided on a bottom of each floating surface facility.

Clause 14: The system of Clause 13, wherein the latching mechanism and the one or more communication couplings are arranged at an interface between the one or more vertical supports and the standardized bottom interface.

Clause 15: The system of Clause 13, wherein the standardized bottom interface of each floating surface facility comprises one or more receptacles configured mate with the one or more vertical supports.

Clause 16: A method of operating a modular floating platform system includes the steps of communicably coupling a detachable floating buoy to a subsea production system at an offshore location via one or more communication lines, the detachable floating buoy providing a central aperture, mating a floating surface facility to the detachable floating buoy, the floating surface facility including a standardized bottom interface comprising a plug portion matable with the central aperture, placing the floating surface facility in communication with the subsea production system via the one or more communication lines as the plug portion mates with the central aperture, and securing the floating surface facility to the detachable floating buoy with a latching mechanism.

Clause 17: The method of Clause 16, wherein mating the floating surface facility to the detachable floating buoy comprises vertically aligning the plug portion with the central aperture, closing a vertical distance between the floating surface facility and the detachable floating buoy, and receiving the plug portion within the central aperture.

Clause 18: The method of Clause 17, wherein closing the vertical distance comprises operating a ballast system included in the floating surface facility and thereby causing the floating surface facility to descend toward the detachable floating buoy.

Clause 19: The method of Clause 17, wherein closing the vertical distance comprises operating a ballast system included in the detachable floating buoy and thereby causing the detachable floating buoy to ascend toward the floating surface facility.

Clause 20: The method of any of Clauses 16 through 19, wherein one or more communication couplings are arranged at an interface between the detachable floating buoy and the floating surface facility, and wherein placing the floating surface facility in communication with the subsea production system comprises mating the one or more communication couplings as the plug portion mates with the central aperture, and facilitating communication between the floating surface facility and the subsea production system via the one or more communication lines once the one or more communication couplings are mated.

Clause 21: The method of any of Clauses 16 through 20, further comprising tethering the detachable floating buoy to the seafloor with a plurality of mooring lines.

Clause 22: The method of any of Clauses 16 through 21, wherein the floating surface facility is a first floating surface facility and the method further comprises decoupling the first floating surface facility from the detachable floating buoy, mating a second floating surface facility to the detachable floating buoy, the second floating surface facility including the standardized bottom interface comprising the plug portion matable with the central aperture, placing the second floating surface facility in communication with the subsea production system via the one or more communication lines as the plug portion of the second floating surface facility mates with the central aperture, placing the second floating surface facility in communication with the subsea production system via the one or more communication lines as the plug portion of the second floating surface facility mates with the central aperture, and securing the second floating surface facility to the detachable floating buoy with the latching mechanism.

Therefore, the present invention is well adapted to attain the ends and advantages mentioned as well as those that are inherent therein. The particular examples and configurations disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative examples disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A modular floating platform system, comprising:

a detachable floating buoy communicably coupled to a subsea production system via one or more communication lines;

a plurality of floating surface facilities individually matable with the detachable floating buoy at a standardized bottom interface provided on each floating surface facility, wherein the standardized bottom interface of each floating surface facility comprises a plug portion sized to be received within a central aperture defined by the detachable floating buoy;

a latching mechanism that individually couples each floating surface facility to the detachable floating buoy when each floating surface facility is individually mated to the detachable floating buoy; and one or more communication couplings that place each floating surface facility in communication with the subsea production system via the one or more communication lines when each floating surface facility is individually mated to the detachable floating buoy.

2. The system of claim 1, wherein the plug portion extends into the central aperture but does not protrude past a bottom of the detachable floating buoy.

3. The system of claim 1, wherein the plug portion extends into the central aperture and past a bottom of the detachable floating buoy.

4. The system of claim 1, wherein the plug portion exhibits a conical shape and an inner surface of the central aperture is angled to accommodate the conical shape.

5. The system of claim 1, wherein the detachable floating buoy is spread-moored to a seafloor with a plurality of mooring lines.

6. The system of claim 1, wherein the one or more communication lines comprise:

one or more riser conduits for transferring production fluids; and one or more umbilicals that facilitate transfer of electrical power, communication signals, and hydraulics.

7. The system of claim 1, wherein the detachable floating buoy further includes a ballast system operable to adjust a buoyancy of the detachable floating buoy.

8. The system of claim 7, wherein the ballast system includes one or more buoyancy connections in fluid communication with one or more ballast tanks, and wherein the ballast tanks are capable of being flooded or evacuated via the one or more buoyancy connections.

9. The system of claim 1, wherein the detachable floating buoy exhibits a circular or polygonal cross-section.

10. The system of claim 9, wherein the detachable floating buoy defines a central aperture that exhibits a circular or polygonal cross-section.

11. The system of claim 9, wherein a body of the detachable floating buoy is axisymmetric.

12. The system of claim 1, wherein the detachable floating buoy includes one or more vertical supports arranged to mate and connect with the standardized bottom interface provided on a bottom of each floating surface facility.

13. The system of claim 12, wherein the latching mechanism and the one or more communication couplings are arranged at an interface between the one or more vertical supports and the standardized bottom interface.

14. The system of claim 12, wherein the standardized bottom interface of each floating surface facility comprises one or more receptacles configured mate with the one or more vertical supports.

15. A method of operating a modular floating platform system, comprising:

communicably coupling a detachable floating buoy to a subsea production system at an offshore location via one or more communication lines, the detachable floating buoy providing a central aperture;

mating a floating surface facility to the detachable floating buoy, the floating surface facility including a standardized bottom interface comprising a plug portion matable with the central aperture;

placing the floating surface facility in communication with the subsea production system via the one or more communication lines as the plug portion mates with the central aperture; and securing the floating surface facility to the detachable floating buoy with a latching mechanism.

16. The method of claim 15, wherein mating the floating surface facility to the detachable floating buoy comprises:

vertically aligning the plug portion with the central aperture;

closing a vertical distance between the floating surface facility and the detachable floating buoy; and receiving the plug portion within the central aperture.

17. The method of claim 16, wherein closing the vertical distance comprises operating a ballast system included in the floating surface facility and thereby causing the floating surface facility to descend toward the detachable floating buoy.

18. The method of claim 16, wherein closing the vertical distance comprises operating a ballast system included in the detachable floating buoy and thereby causing the detachable floating buoy to ascend toward the floating surface facility.

19. The method of claim 15, wherein one or more communication couplings are arranged at an interface between the detachable floating buoy and the floating surface facility, and wherein placing the floating surface facility in communication with the subsea production system comprises:

mating the one or more communication couplings as the plug portion mates with the central aperture; and facilitating communication between the floating surface facility and the subsea production system via the one or more communication lines once the one or more communication couplings are mated.

20. The method of claim 15, further comprising tethering the detachable floating buoy to the seafloor with a plurality of mooring lines.

21. The method of claim 15, wherein the floating surface facility is a first floating surface facility and the method further comprises:

decoupling the first floating surface facility from the detachable floating buoy;

mating a second floating surface facility to the detachable floating buoy, the second floating surface facility including the standardized bottom interface comprising the plug portion matable with the central aperture;

placing the second floating surface facility in communication with the subsea production system via the one or more communication lines as the plug portion of the second floating surface facility mates with the central aperture;

placing the second floating surface facility in communication with the subsea production system via the one or more communication lines as the plug portion of the second floating surface facility mates with the central aperture; and securing the second floating surface facility to the detachable floating buoy with the latching mechanism.

* * * * *